United States Patent [19]

Mistry et al.

[11] Patent Number: 5,040,390

[45] Date of Patent: Aug. 20, 1991

[54] LOCK AND CONTROL ASSEMBLY FOR A VEHICLE TAILGATE

[75] Inventors: Narhari C. Mistry, Anderson, Ind.; Thomas Grzanka, Rochester; Lawrence Youhanian, Roseville, both of Mich.

[73] Assignee: General Motors Corporation, Detroit, Mich.

[21] Appl. No.: 437,243

[22] Filed: Nov. 16, 1989

[51] Int. Cl.[5] ..... E05B 65/12

[52] U.S. Cl. ..... 70/241; 70/264; 70/279; 292/216; 292/280; 292/DIG. 43; 292/336.3

[58] Field of Search ..... 70/241, 240, 263–265, 70/279; 292/201, 216, 336.3, 280, DIG. 14, DIG. 43

[56] References Cited

U.S. PATENT DOCUMENTS

| | | | |
|---|---|---|---|
| 2,950,138 | 8/1960 | Meyer et al. | 292/229 |
| 3,241,344 | 3/1966 | Peters | 70/279 |
| 4,076,301 | 2/1978 | Gergoe | 292/216 X |
| 4,157,844 | 6/1979 | Sarosy et al. | 292/216 |
| 4,364,590 | 12/1982 | Hamada | 292/280 X |
| 4,678,212 | 7/1987 | Rubio | 292/DIG. 43 X |
| 4,722,206 | 2/1988 | Nakamura et al. | 70/240 |

FOREIGN PATENT DOCUMENTS

| | | | |
|---|---|---|---|
| 262959 | 4/1988 | European Pat. Off. | 70/264 |
| 269784 | 6/1988 | European Pat. Off. | 70/264 |
| 3017731 | 11/1981 | Fed. Rep. of Germany | 70/264 |
| 3513555 | 11/1986 | Fed. Rep. of Germany | 70/264 |
| 3532414 | 11/1986 | Fed. Rep. of Germany | 70/264 |

*Primary Examiner*—Robert L. Wolfe
*Assistant Examiner*—Suzanne L. Dino
*Attorney, Agent, or Firm*—William A. Schuetz

[57] ABSTRACT

The disclosure involves a lock and control assembly which can be either manually operated after insertion of a key in a lock cylinder or electrically energized by a switch from a remote location so that it can be thereafter manually manipulated without insertion of the key in the lock cylinder. The lock and control assembly also includes a mechanical override means to enable it to be actuated to its locked position, but not its unlocked position, in the event of an electrical power failure or a failure in the energizable means.

15 Claims, 6 Drawing Sheets

FIG - 13
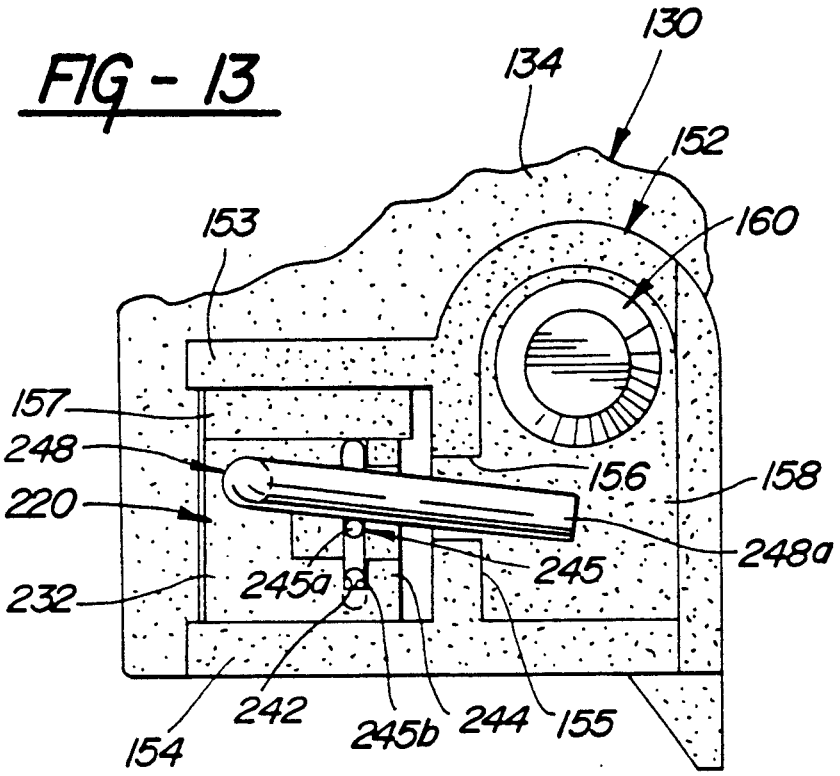
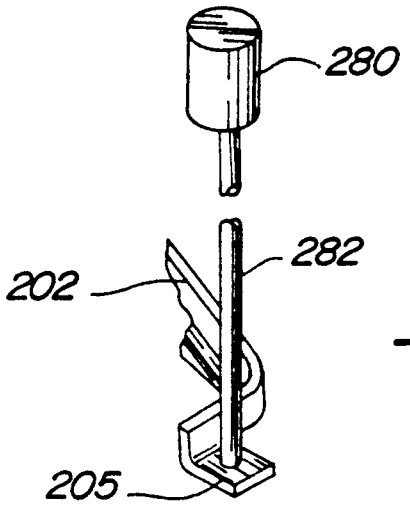
FIG - 14

LOCK AND CONTROL ASSEMBLY FOR A VEHICLE TAILGATE

The present invention relates to a lock and control assembly or a rear closure, preferably a tailgate or liftgate, of an automotive vehicle and, more particularly, to a lock and control assembly which can be either manually operated after insertion of a key or remotely actuated by an energizable means to enable the assembly to be then manually operated without insertion of a key, and in which the control assembly includes a mechanical override means to enable it to be actuated to its locked position, but not to its unlocked position, in the event of a power failure or a failure in the energizable means.

U.S. Pat. No. 4,157,844, which is assigned to the same assignee as the present invention, discloses a lock and control assembly for a vehicle tailgate having a pivotal gate portion and a window portion independently movable relative to the gate portion. The lock and control assembly therein disclosed is operable such that the window portion has to be released first prior to releasing the gate portion. In this lock and control assembly, the window portion is retained in its closed position by the capture of a striker bar carried by the window. A pivotal fork bolt carried by a support on the gate portion is employed to receive the striker to latch the same to the gate portion. The fork bolt is held in its window latching position by the hooking action of a detent lever which is operably attached to a first actuating lever of the control assembly. The actuating lever is directly and selectively actuated by an operating member or lever of a rotatable key operated lock cylinder carried on the outer panel of the gate portion. A second actuating lever is also positioned for actuation by the same operating member of the lock cylinder but cannot be rotated until the first lever is moved to an unlatching position. A projection or locking portion on the first lever positively prevents rotation of the second lever until the first lever is moved to an unlatched position. Once is the first lever is so moved, the second lever may be pivoted by rotation of the lock cylinder in the opposite direction to its unlatching position, which releases a remote gate latch mechanism allowing the tailgate portion to be opened.

U.S. Pat. No. 3,241,344, which is assigned to the same assignee as the present invention, discloses a dual arrangement for locking and unlocking a lock cylinder for a rear closure, such as a deck lid. That is, in addition to the lock cylinder being rotatable in opposite directions to open and close the deck lid in response to a key being inserted therein, the lock cylinder also can be locked and unlocked independently of the key by an electrically energizable solenoid from a switch in the vehicle interior and thereafter rotated via a finger engaging or manually manipulatable means located exteriorly of the deck lid, to unlatch and latch the deck lid as many times as an operator wishes. This arrangement, however, required that the solenoid remain energized for as long as the operator desired to be able to latch and unlatch the deck lid without using a key, which depending on the duration thereof, provides a drain on the vehicle battery.

The present invention provides a dual locking and unlocking arrangement employing a reversible electric motor which only has to be momentarily energized. The present invention further provides a novel, mechanically operated override means to lock the lock cylinder against rotation by the finger engaging means should the reversible electric motor not be operable, after having unlocked the lock cylinder, to return the same to its locked condition due to a power failure or a failure in the motor, the mechanical override means being thereafter ineffective to unlock the lock cylinder even if mechanically operated.

The lock and control assembly of the present invention can be utilized both with a tailgate having a window independently movable of its gate portion or with a tailgate in which the window is stationarily mounted thereto. Moreover, the provisions of the present invention could also be made applicable for use with hatchbacks or rear deck lids for vehicles.

Accordingly, it is an object of the present invention to provide a new and improved lock and control assembly for use with a vehicle rear closure, preferably a tailgate, which is pivotally movable between open and closed positions, the lock and control assembly including a support frame carried by the tailgate, latch means for latching and unlatching the tailgate to and from associated body structure of the vehicle when in its closed position, the latch means including a first lever pivotally supported by the support frame for movement in opposite directions, a lock cylinder actuating mechanism carried by the tailgate and operatively associated with the first lever for pivotally moving the same to affect unlatching of the tailgate when rotated in a first direction, the lock actuating cylinder mechanism including a stationary casing, a cylindrical sleeve rotatably supported by the casing, a key operated lock cylinder supported by the sleeve and an actuator member rotatable with the lock cylinder and operatively associated with the first lever, and in which the lock cylinder is rotatable relative to the sleeve upon insertion of a key to cause the actuator to move the first pivotable lever to effect unlatching of the tailgate when rotated in one direction and being locked against rotation relative to the sleeve when the key is removed, and wherein the lock and control assembly also includes a selectively operable, reversible power operated locking means including a reciprocable blocking member for locking and unlocking the sleeve to and from the stationary casing to prevent and enable the sleeve and lock cylinder from being rotated and rotated in unison by an exteriorly located manually manipulatable means connected to the lock cylinder, respectively, the reciprocable blocking member being movable between a locked position in which it extends through aligned openings in the casings and the sleeve to lock the cylinder and sleeve against rotation in unison relative to the casing by the manually manipulatable means and an unlocked position in which the blocking member is retracted from the opening in the sleeve to permit rotation of the sleeve and lock cylinder in unison relative to the casing by the manually manipulatable means, and which includes a mechanical override means operatively associated with said reciprocable blocking member for effecting movement of the blocking member from its unlocked position to its locked position to lock the sleeve and locking cylinder against rotation in unison relative to the stationary casing in the event there is a power failure or malfunction of the power operated means so that the tailgate can be locked in its closed position, the mechanical override means being at all times ineffective to move the blocking member from its locked position to its unlocked position.

Another object of the present invention is to provide a new and improved locking control assembly, as defined in the preceding object, and wherein the power operated means comprises a housing means, a rack connected with said blocking member and which is slidably supported by the housing for reciprocable movement and a reversible electric motor carried by the housing means for rotating a pinion gear in meshed engagement with the rack in opposite directions, and wherein the rack includes a deflectable bowed leaf spring having a detent which rides against a wall surface in the housing and with the wall surface having a nib extending toward the bowed leaf spring and in the path of movement of the detent whereby said rack upon being reciprocated to move the blocking member to either its locked or unlocked positions is detented in position.

Another object of the present invention is to provide a new and improved lock and control assembly as defined in the preceding objects and wherein the reciprocable blocking member comprises a pin having a radially extending shoulder intermediate its ends and wherein the override means includes a carrier reciprocably supported by the power operated locking means adjacent to the blocking member for movement between first and second positions, a spring biased detent carried by the carrier for movement therewith and which is biased toward engagement with the blocking member and an actuating means operatively connected with said carrier for moving the latter between its positions, the actuating means including a spring means for biasing the carrier towards its second position, and wherein the spring biased detent is cammed over and snapped behind the shoulder on the blocking member when the carrier is moved from its second position towards its first position when the blocking member is in its unlocked position whereby the detent will engage the shoulder on said blocking member and move the latter towards its locked position when the spring means of the actuating means causes the carrier to be moved from its first position towards its second position, the spring biased detent merely idling on the blocking member should the actuating be thereafter operated to reciprocate the carrier.

A further object of the present invention is to provide a new and improved lock and control assembly, as defined in any of the preceding objects, and wherein the mechanical override means is activated by rotating the manually manipulatable means in a direction opposite to the direction of unlatching movement of the tailgate and then rotating it back towards its former position.

Yet another object of the present invention is to provide a new and improved lock and control assembly, as defined in any of the first three objects, and wherein the mechanical override means is activated by independently moving the actuating means connected with the carrier and then releasing the same.

Still anther object of the present invention is to provide a new and improved lock and control assembly, as defined in any of the first three objects, and wherein the tailgate includes a window independently movable between open and closed positions in response to rotation of the manually manipulatable means in a direction opposite the direction of rotation for unlatching the tailgate, and wherein the manual override means is actuated to lock the tailgate in response to movement of the window from its open position towards its closed position.

The present invention further resides in various novel constructions and arrangement of parts, and further objects, novel characteristics and advantages of the present invention will be apparent to those skilled in the art to which it relates and from the following detailed description of the illustrated, preferred embodiments thereof made with reference to the accompanying drawings forming a part of this specification and in which similar reference numerals are employed to designate corresponding parts throughout the several views, and in which:

FIG. 13 is an enlarged end elevational view of part of the lock and control assembly of the present invention and looking in the direction of the arrows 13—13 of FIG. 9; and FIG. 14 is a fragmentary perspective view of an alternate embodiment of part of the lock and control assembly of the present invention.

Figure 1:
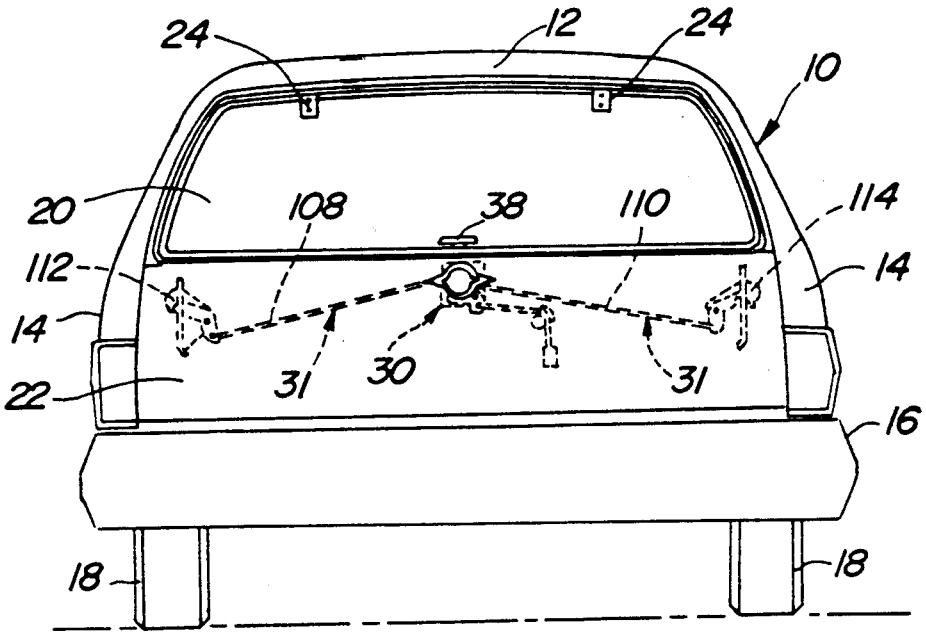
FIG. 1 is a rear elevational view of a station wagon vehicle having a tailgate which incorporates the novel lock and control assembly of the present invention.
Figure 3:
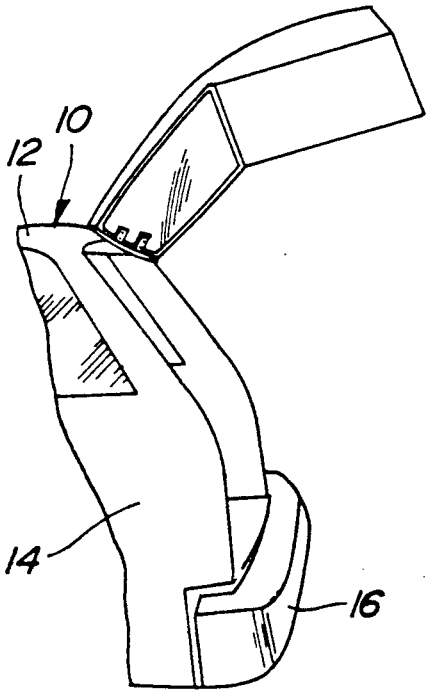
FIG. 3 is a view like that shown in FIG. 2, but showing a second embodiment of the present invention in which the tailgate has a stationary window.
Figure 2:
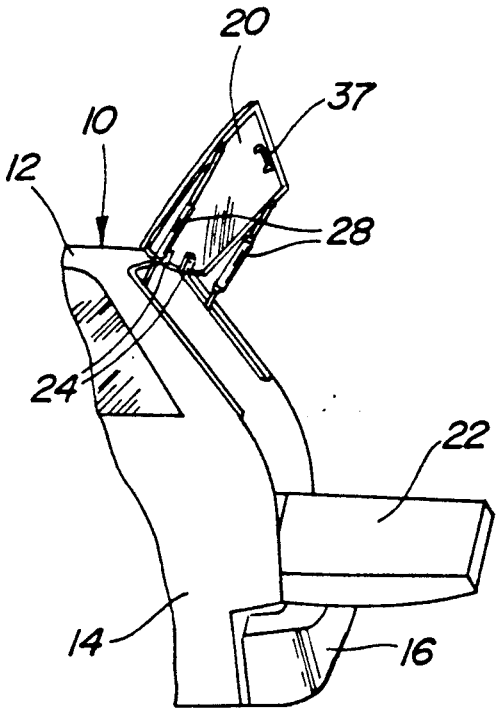
FIG. 2 is a fragmentary side elevational view of the vehicle shown in FIG. 1, but showing the tailgate with its window and gate portions in their open position.

Referring to FIG. 1, an automotive vehicle 10 is thereshown. The vehicle has body structure including a roof 12, rear quarter side panels 14, the rear bumper 16, wheels 18, and a tailgate or tailgate assembly which includes an upper window or view portion 20 and a lower gate portion 22. In the preferred embodiment, the upper window portion 20 is pivotally supported via hinges 24 so as to swing outward and upward, as shown in FIG. 2, to an open position. The window 20 is held in its open position by two gas cylinders or struts 28 along its opposite sides, which devices have their opposite ends pivotally connected to the vehicle body structure and sides of the tailgate assembly, and in a manner that is conventional in the art.

As best shown in FIG. 2, the lower gate portion 22 can be moved from its closed position, as shown in FIG.

1, to its open position, as shown in FIG. 2, in which it is generally horizontally disposed. The gate portion supports a cylinder lock actuating mechanism 30 and a lock control mechanism 31 for locking the window 20 to the gate portion 22 and for locking the gate portion 22 to associated side body structure 14 of the vehicle 10.

Figure 6:
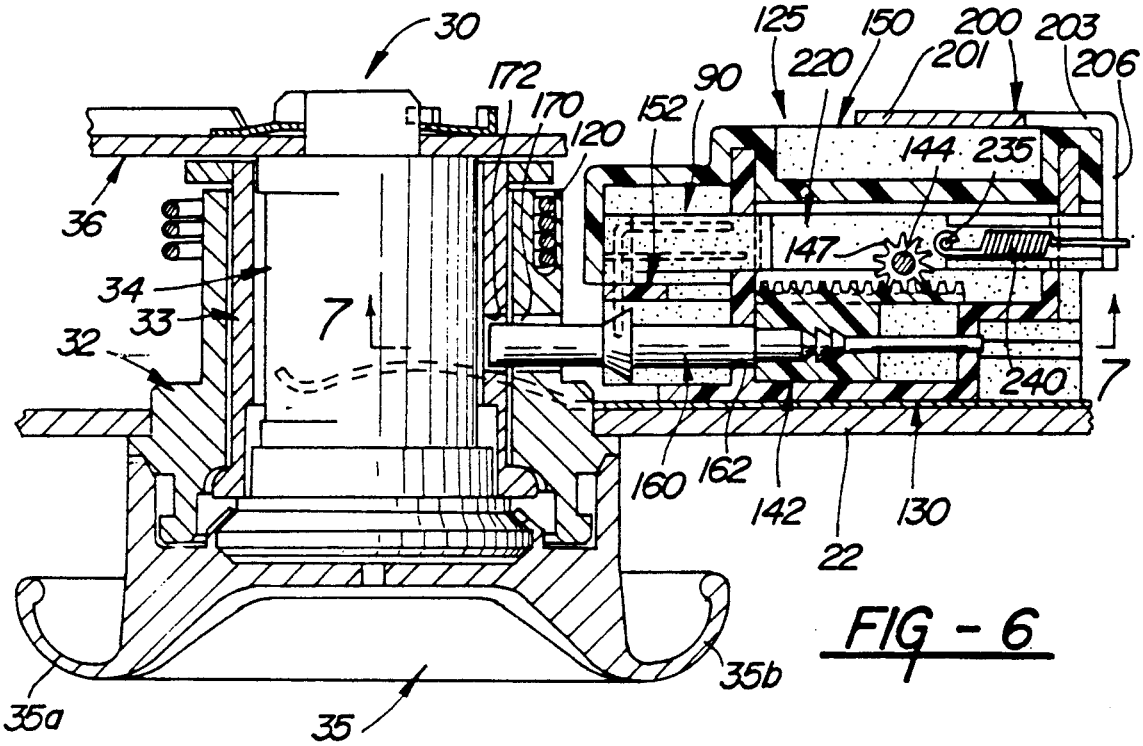
FIG. 6 is an enlarged fragmentary sectional view of part of the lock and control assembly and taken along the lines 6—6 of FIG. 5.

As best shown in FIG. 6, the cylinder lock actuating mechanism 30 comprises a stationary casing 32 which is secured to the gate portion 22 and extends to the exterior of the gate portion 22, a sleeve 33 rotatably supported by the casing 32, a lock cylinder 34 rotatably supported by the sleeve 33, a manually manipulatable or finger engaging winged operating member 35 drivingly connected to the lock cylinder 34 and disposed exteriorly of the gate portion 22 and an operating member or lever 36 drivingly connected to the lock cylinder 34 at its end located interiorly of the tailgate portion 22. The winged operating member includes two wing portions 35*a* and 35*b* so as to enable the same to be easily grasped by the fingers and rotated. The lock cylinder 34 is of a conventional tumbler type and is normally locked against rotation relative to the sleeve 33, but can be rotated relative to the sleeve 33 upon insertion of a proper key so that the winged member 35 can rotate the operating member or lever 36 in opposite directions.

Figure 4:
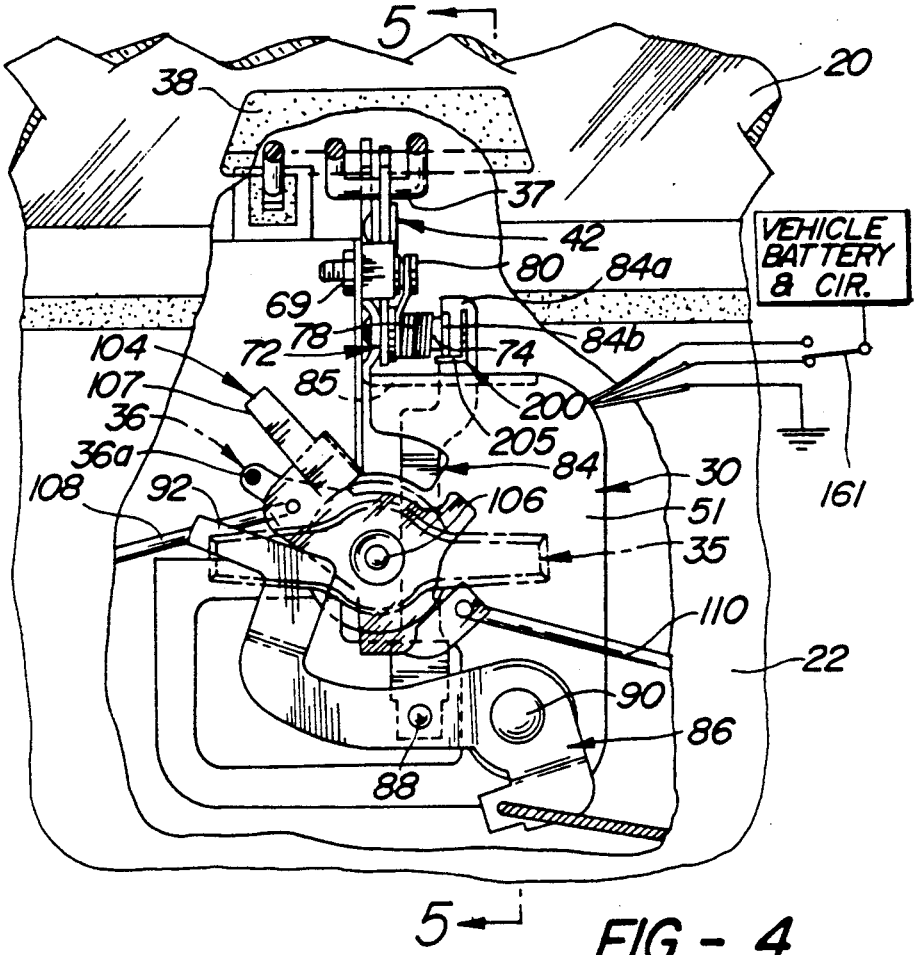
FIG. 4 is an enlarged, fragmentary rear elevational view of part of the tailgate shown in FIG. 1, but with portions of the tailgate broken away to reveal part of the lock and control assembly of the present invention.
Figure 5:
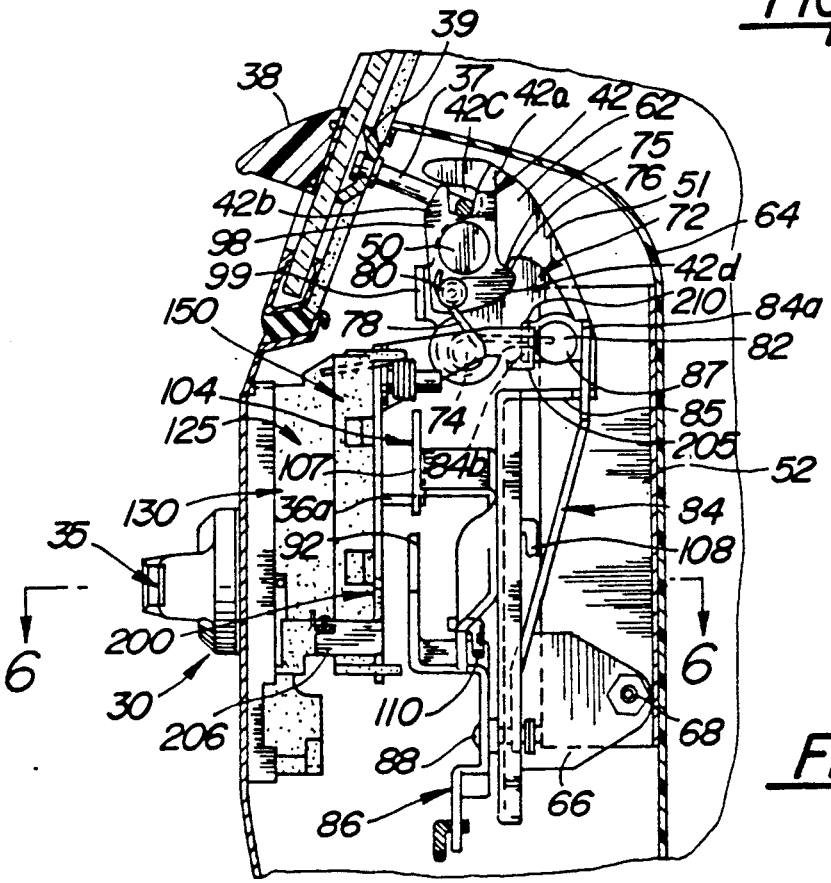
FIG. 5 is a fragmentary section view taken along the lines 5—5 of FIG. 4.

As best shown in FIGS. 4 and 5, the window portion 20 has a substantially U-shaped striker bar 37 projecting therefrom which acts as a striker to hold the window portion 20 in its closed position. The striker bar 37 is connected through the window portion 20 to an exterior handle 38. The striker bar 37 is itself attached to an inner support bar 39 which is itself connected to the handle 38 by suitable fastener means (not shown) extending through holes in the window portion 20.

The striker bar 37 is engaged or captured when the window 20 is in its closed position by a rotatable fork bolt member 42 which has spaced arms 42*a* and 42*b* defining a throat portion 42*c* therebetween. Fork bolt 42 pivots or rotates about a rivet like pin 50 which is carried by a stationary support frame 51 secured to the tailgate portion 22. The fork bolt 42 is pivoted clockwise from its position shown in FIG. 10 by the striker bar 37, in response to closing movement of the window 20, to the position shown in FIG. 5, in which the throat portion 42*c* and outer arm 42*b* receive and hold the striker bar 37 and the window 20 in its closed position, as shown in FIG. 5.

Referring to FIGS. 4 and 5, the control mechanism 31 includes the frame 51, which is mounted on an inner panel 52 of the gate portion 22. Frame 51 supports pin 50, which in turn rotatably supports bolt 42. The frame 51 includes an upper vertically disposed hooked portion 62 which positively captures the striker bar 36 in association with the arms 42*a*, 42*b* and throat portion 42*c* of the fork bolt 42. The hooked portion 62 is concealed in the gate portion 22 and hidden by a decorative cover or trim panel 64 which also covers the inner panel 52 of the gate portion 22. The frame 51 is attached to the inner panel 52 by conventional fastener means and specifically includes a bracket 66 through which a fastener means 68 can extend. Another fastener 69 (see FIG. 4) attaches the frame 51 to the panel 52 at its upper end.

The frame 51 also supports a detent lever 72 pivoted about a rivet like fastener 74 at a location adjacent to, but below the attachment of fork bolt 42 to frame 51 by pin 50. The detent lever 72 has a hooked end portion 75 which engages a shoulder 76 on the fork bolt 42 to maintain it in the latched position shown in FIG. 5. A coil spring member 78 biases the detent lever 72 to the position shown in FIG. 5 and includes a coiled portion surrounding the fastener 74 and two ends, one of which is secured by member 80 to the bolt 42 while the other is operatively connected to the detent lever 72, as will be hereinafter more fully described.

Figure 10:
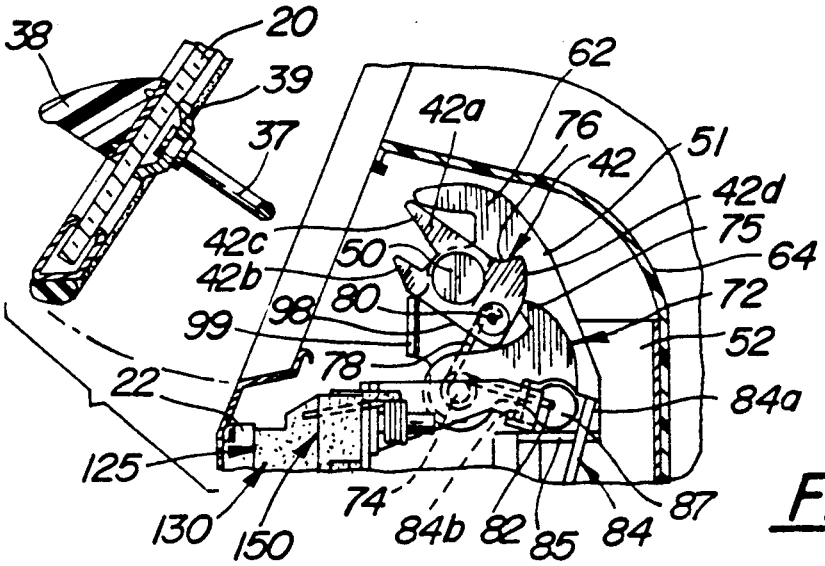
FIG. 10 is a fragmentary sectional view like that shown in FIG. 5 but showing different parts thereof in different positions.

The detent lever 72 is operatively attached by a strap or connector 84 to a first operating or actuating lever 86, as is best shown in FIG. 4. The upper end 84*a* of the strap is U-shaped and the upper end portion of the connector 84 is configured to avoid a bent portion 85 of frame 51, as shown in FIG. 5. A rivet fastener 87 attaches the upper end 84*a* of the connector 84 to the detent lever 72, the other end 82 of torsion spring 78 engages a lateral flange 84*b* at the upper end 84*a* of connector 84 as shown in FIG. 5 to operatively connect spring 78 to the detent lever 72 so as to bias the latter for movement in a counterclockwise direction, as viewed in FIG. 5. The connector 84 is fastened to lever 86 via a fastener 88, as shown in FIG. 4, the fastener extending through a slot (not shown) in the frame 51. The first lever 86 is attached to frame 60 by a rivet fastener 90. This permits lever 86 to pivot about the fastener axis. The lever 86 has an arm portion with a surface or edge 92 thereon. The actuating member or lever 36, which is connected to the rotatable lock cylinder 34, is located so that its inwardly extending portion 36*a* projects adjacent to the surface 92. When the lock cylinder 34 is rotated in a counterclockwise direction, as shown in FIGS. 1 and 4, the portion 36*a* of lever 36 engages the surface 92 to pivot the first operating lever 86 counterclockwise. Rotation of the lever 86 in this direction then moves the connector 84 downwardly thereby pivoting the detent lever 72 clockwise, as shown in FIG. 5. After hook portion 75 moves clear from portion 76, the fork bolt 42 is free to rotate counterclockwise about pin 50 thereby releasing the striker 37, as viewed in FIG. 5, the spring 78 causing this movement, since its engagement with pin 80 is located beneath the axis of pin 50. Thereafter, the gas cylinders 28 move the window 20 to the open position shown in FIG. 2. As long as the window 20 remains in the open position, the spring 78 holds the fork bolt 42 in an unlatched position, as shown in FIG. 10. In this position the undersurface 98 of the fork bolt 42 engages the end portion of the frame flange 99 and the arcuate bottom end surface 42*d* of the fork bolt 42 holds the detent lever 72, connector 84 and first lever 86 in the release position shown in FIG. 10.

Referring to FIG. 4, it can be seen that the second operating lever 104 is attached to frame 60 via fastener 106 and, as viewed in FIG. 4, is adapted to pivot thereabout in a clockwise direction in response to clockwise movement of the actuator member 36. Rotation of the member 36 in a clockwise direction in FIG. 1 will cause the projecting portion 36*a* thereof to bear against a surface 107 of lever 104, thus producing clockwise rotation of the lever 104.

As best shown in FIG. 1, the lever 104 is connected via rod connectors 108 and 110 to left hand and right hand gate latch mechanisms 112 and 114. The gate latch mechanisms can be of any suitable or of a conventional type and reference is made to U.S. Pat. No. 3,400,216 for details of a suitable latch mechanism for this purpose. The clockwise rotation of the second operating lever 104 moves the rods 108 and 110 inward toward the center line of the gate thereby releasing the gate portion 20 so that it may be pivoted downward to its open position, as shown in FIG. 2.

From the foregoing, it should be apparent that when the key is inserted into the lock cylinder 34, the lock cylinder 34 and actuating member 36 can be rotated in a counterclockwise direction, as viewed in FIG. 1. Rotation of the actuating member 36 in this direction causes the portion 36*a* thereof to engage the operating lever 96 to rotate it in a counterclockwise direction, which in turn pulls down on the strap 84 and pulls down on the detent member 72. This releases the fork bolt 42 for movement from its lock position, as shown in FIG. 5, to a release position, as shown in FIG. 10, to enable the window portion 20 to be moved to its open position. The detent lever 72, strap 84 and the first lever 86 remain in the release position because of the engagement between the fork bolt undersurface 98 and the detent lever 72. When the lock cylinder 34 is released, the lock cylinder and operating lever 35 will be returned to their normal or mid position, as shown in FIG. 1, by a return torsion spring 120. The spring 120 has one end in engagement with the operating lever 36 and its other end in engagement with the stationary casing 32.

When the window portion 20 is open, the lock cylinder 34 can then be rotated in a clockwise direction so that the actuating lever 36 can now engage and move the second operating lever 104 in the same clockwise direction, as viewed in FIGS. 1 and 4. Movement of the lever 104 in a clockwise direction causes the control mechanism 31 to be actuated to disengage the gate latch mechanisms 112, 114 from the adjacent side structure of the vehicle 10 to enable the gate portion 22 to be moved from its closed position, as shown in FIG. 1, towards its open position, as shown in FIG. 2.

Figure 12:
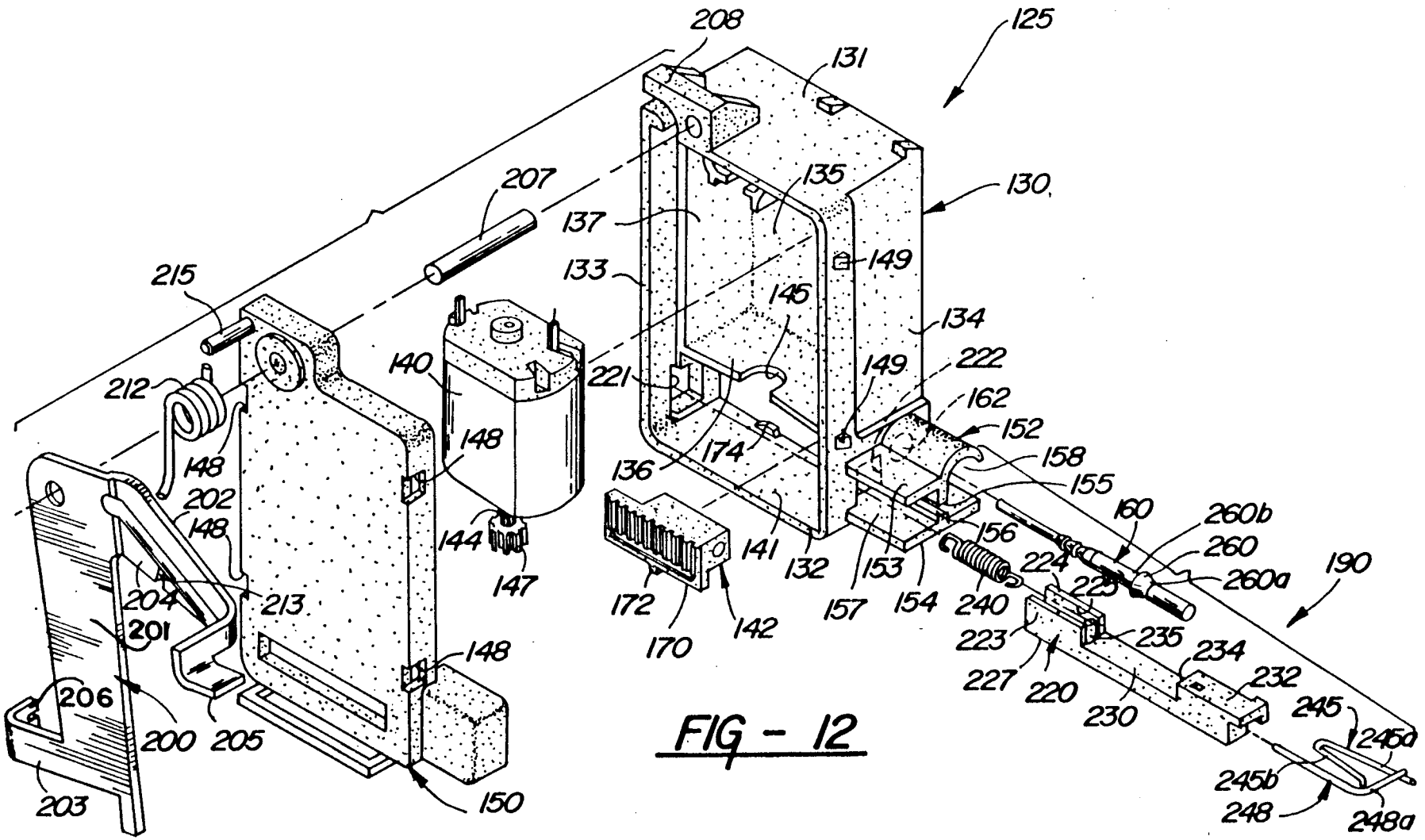
FIG. 12 is an exploded perspective view of part of the lock and control assembly of the present invention.

The lock and control assembly 30 also includes a selectively operable, electrically energizable locking means 125 for locking and unlocking the lock cylinder 34 for and against rotation relative to the stationary casing 32. The locking means 125, as best shown in FIGS. 5 and 12, comprises a plastic motor housing 130 which is of a generally rectangular shape. The housing 130 has a top wall 131, a bottom wall 132, left and right side walls 133 and 134 and an intermediate wall 136 spaced upwardly from the bottom wall 132 between the sides 133 and 134 and extending laterally. The walls 131, 133, 134 and 136 define a rectangular compartment 137 for retaining a reversible electric motor 140 therein and the walls 132, 133, 134 and 136 define a second smaller rectangularly shaped compartment 141 for housing a reciprocable plastic rack 142 therein. The electric motor 140 has a shaft 144 which extends through an opening 145 in the intermediate wall 136 and which is drivingly connected to a pinion gear 147. The pinion gear 147 is in meshed engagement with teeth on one side of the rack 142 and with the rack 142 being reciprocable between the side walls 133 and 134. The compartments 137 and 141 of the housing 130 are covered by a cover 150 which is suitably secured to the housing 130 via cooperable snap fitting fastener means 148 and 149 on the cover 150 and housing 130.

The housing 130 also includes a side portion 152 which is integral with the side wall 134. The side portion 152 has a top side 153, a bottom side 154 and a vertically disposed wall 155 at its midportion. The wall 155 has a slot 156 therethrough to communicate the space or compartment 157 between the top and bottom sides 153, 154 on one side of the wall 155 with the space or compartment 158 between the top and bottom sides 153, 154 on the other side of the wall 155. The rack 142 has secured thereto a blocking member 160 in the form of a pin which extends through an opening 162 in the side wall 134 of the housing 130 and into the compartment 158 of the side portion 152. The axis of rotation of the shaft 144 of the electric motor is vertical and at a right angle to the reciprocable movement of the rack 142, which movement is horizontal and toward and from the lock cylinder 34. The motor 140 is adapted to be selectively energized for rotation in either direction via a suitable switch means 161 located in the interior of the vehicle 10 and which is operatively connected to the vehicle battery and motor via suitable or conventional electrical circuitry to enable the motor 140 to be rotated in either direction to cause the rack 142 and blocking member 160 to be reciprocated in either direction.

Figure 8:
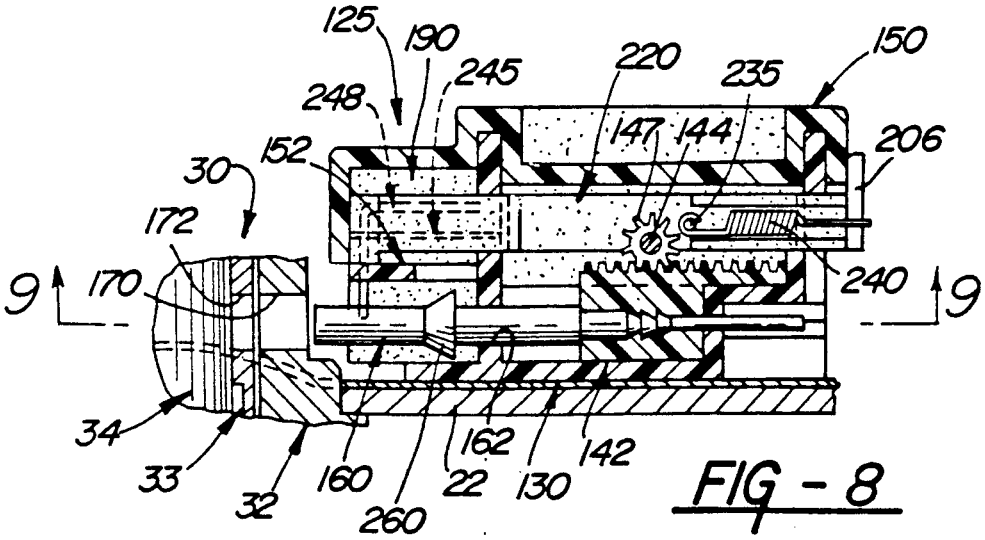
FIG. 8 is a fragmentary sectional view like that shown in FIG. 6 but showing different parts thereof in different positions.
Figure 9:
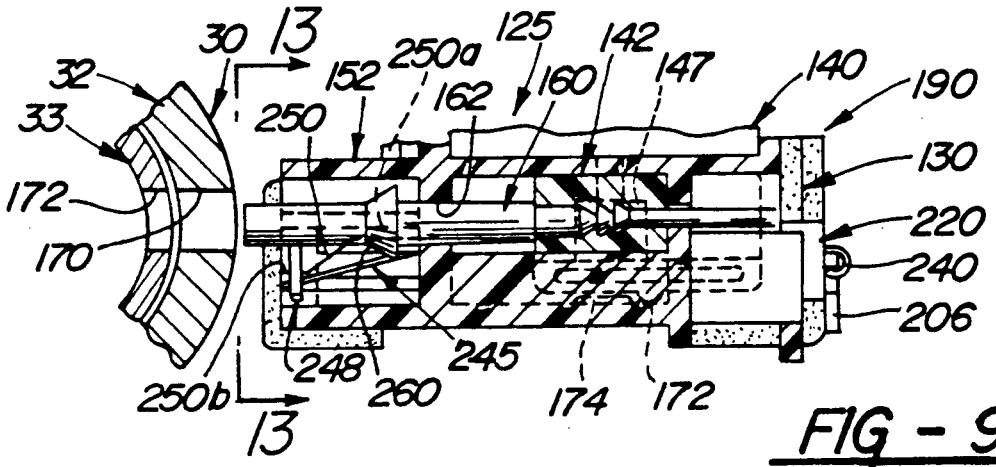
FIG. 9 is a fragmentary sectional view taken along the lines 9—9 of FIG. 8.

The operation of the selectively operable power operated means will now be described. When the operator desires to be able to unlock the window portion 20 and the gate portion 22 without the use of a key, he need merely actuate the switch means 161 to the unlock position. When the electric motor is energized, the pinion gear 144 is rotated which in turn causes the rack 142 to be reciprocated. As best shown in FIGS. 6 and 8, when the lock cylinder sleeve 33 is locked against rotation relative to the casing 32, the blocking member 160 is in the position shown in FIG. 6. In this position, the block member extends through aligned openings 170, 172 in the casing 32 and the sleeve 33 and the rack 142 is in its extreme left position against the side wall 134 of the housing 130. Thus, when the switch in the interior of the vehicle is actuated to the unlock position, the electric motor is energized and rotated in the direction to move the rack 142 from its leftmost position, as shown in FIG. 6, towards its rightmost position, as shown in FIG. 8. This in turn will cause movement of the blocking member 160 from its leftmost position as shown in FIG. 6, in which it locks the sleeve 33 to the casing 32 towards its rightmost position, as shown in FIG. 8, in which the free end of the pin 160 is removed from the sleeve 33 and casing 32.

When the blocking member has been moved to its unlocked position, the operator need merely rotate the winged finger engaging means 35 in a counterclockwise direction to cause the actuating member 36 to be rotated in a counterclockwise direction. This movement is permitted because the sleeve and lock cylinder 34 are now free to rotate in unison without the need for any key. Rotation of the actuating member 36 in the counterclockwise direction effects unlocking of the window portion 20 and then rotation in a clockwise direction affects unlatching of the gate portion 22, and in the same manner as hereinbefore described in connection with the use of a key.

When it is desired to lock the tailgate portion 22, after the window 20 and gate portion 22 are in their closed positions, the operator need merely actuate the switch means 161 to the lock position. This will cause the motor 140 to be energized and rotated in the opposite direction to move the rack 142 and blocking member 160 from the position shown in FIG. 8 to the position shown in FIG. 6 in which the blocking member 160 locks the sleeve 33 to the casing 32.

It is sometimes desirable to be able to unlock the window portion 20 and gate portion 22 of a tailgate from a remote location inside the vehicle and without requiring the use of a key. Also, the operator may want to be able to repeatedly open and close the window and gate portions without using a key or requiring that the key remain visible within the lock should the operator be unloading and moving away from the vehicle.

In accordance with one of the provisions of the present invention, a novel detent means is provided to ensure that the rack 142 remains in the position to which is moved by the electric motor 140. Since the shaft of the motor 144 is more or less freely rotatable when the motor is deenergized, it would be possible for the shaft 144 to rotate due to road vibration, etc. and thus cause an unwanted unlocking of the sleeve 33 from the casing 32. The detent means prevents this. As shown in FIG. 12, the detent means comprises an integral leaf spring 170 which is integral with the rack at its opposite ends but spaced from the underside of the rack. The spring is self-biased to a normal free state position, as shown in FIG. 12. The spring 170 includes a detent 172 in the form of a projection extending downwardly therefrom intermediate its opposite ends, as viewed in FIG. 12. Likewise the housing 130 intermediate the sides 133 and 134 and integral with the wall 132 has a nib 174. As shown in FIG. 12, the nib 174 has tapered sides. In operation, when the rack 142 is reciprocated in either of its directions, the detent 172 of the spring 170 engages the nib 174 on the bottom wall 132 of the housing 130 and causes the leaf spring 170 to be deflected upwardly from its normal free state position and in opposition to its self-biasing forces until the detent 172 clears the nib 174 whereupon the leaf spring 170 returns the detent 172 back to engagement with the wall 132. This nib 174 will retain the rack 142 in the locked position when moved thereto to move the blocking 160 to the locked position shown in FIG. 6. Likewise the nib 174 will retain the rack 142 and blocking member 160 in their unlocked position, as shown in FIG. 8, when moved thereto.

In accordance with another and major provision of the invention, a novel mechanical override means 190 operatively associated with the reciprocable blocking member 160 is provided for effecting movement of the blocking member 160 from its unlocked position, as shown in FIG. 8, to its locked position, as shown in FIG. 6, to lock the sleeve 33 to the stationary casing 32 to prevent the sleeve 33 and locking cylinder 34 from being rotated in unison relative to the stationary casing 32 in the event there is a power failure or malfunction of the power operated means 140 so that the tailgate can be locked in its closed position. This mechanical override means 190 is needed because without it and, if the tailgate portion 22 is unlocked and the blocking member 160 is in the position shown in FIG. 8, and if there is a power failure or failure in the power operated means 140, there is no way the blocking member 160 could be moved to its locked position, as shown in FIG. 6 and thus prevent rotation of the lock cylinder 34.

As best shown in FIG. 12, the mechanical override means 190 comprises an actuating lever 200 having a planar vertical portion 201 and first and second transversely extending legs 202 and 203. The leg 202 comprises a first portion 204 which is bent so as to form an obtuse included angle with the planar portion 201 and an L-shaped end portion 205 at its free end which extends transversely of the portion 204. The leg 203 is generally L-shaped to define a free end portion 206 which extends normal to the plane of a planar portion 201. The actuating lever 200 is adapted to be pivotally connected to the cover 150 and the housing 130 by a pivot pin means 207 which extends through aligned openings in a boss 208 integral with the upper wall 131 of the housing 130, the cover 150 and the actuating lever 200 adjacent its upper leftmost end. The lever 200 is disposed exteriorly of the cover 150 and with the planar portion 201 being slidable on or located closely adjacent to the exterior side of the cover 150. As best shown in FIG. 5, the lever 200 when pivotally connected to the cover 150 has its L-shaped end portion 205 of the leg 202 disposed underneath the flange **84*b* of the strap 84 which in turn is pivotally connected to the detent lever 72 via the pivot pin or rivet 85. The lever 200 has its free end portion 206 of its other leg 203 disposed adjacent the side wall 133 of the housing 130 at its lower end. The lever 200 is adapted to be biased so that its end portion 205 of the leg 202 engages the underside of the flange 84*b* of the strap 84 and the free end 206 of the leg portion 203 biased into engagement with the side wall 133 of the housing by a torsion spring 212. The torsion spring 212 is carried by the pivot pin means 207 and has one end engageable with a notch 213 in the first portion 204 of the leg 202 of the lever 200 and its other end in engagement with the underside of an integral pin 215 carried by the housing 150**.

As best shown in FIGS. 6, 8 and 12, the mechanical override means 190 further includes a carrier 220 which is slidably supported by the housing 130 and which is disposed within the compartment 141. The carrier 220 is disposed closely adjacent to the through aligned openings 221 and 222 in the side walls 133 and 134 of the housing 130. The carrier 220 is generally rectangular in shape and includes a left hand end portion 227, as viewed in FIG. 12, which comprises a pair of spaced side walls 223 and 224 which define a channel 225 therebetween, an intermediate portion 230 of a lesser height than the end portion 221 and a right hard end portion 232 of a greater height than the intermediate portion 230. The intermediate portion 230 with the end portions 227 and 232 define a recess or slot 234 so that a portion of the pinion gear 147 can extend therein without interfering with movement of the carrier 220. The end portion 227 at its end adjacent the intermediate portion 230 includes an upwardly extending pin 235 around which is wrapped one end of a tension spring 240, the other end of the tension spring extending through the opening 221 in the side wall 133 of the housing and being attached to the end 206 of the leg 203 of the actuating lever 200. The channel 225 slidably guides the tension spring 240 and the tension spring 240 provides a take up between the carrier 220 and the lever 200 to accommodate variations in tolerance limitations and variations in movement of the lever 200 by the strap 84.

The right end 232 of the carrier, as best shown in FIG. 13, has a C-shaped channel or slot extending longitudinally thereof and which is open on its side 244 facing the wall 155 of the side portion 152 of the housing 130. Disposed within the channel 244 is a hairpin shaped spring 245 whose legs **245*a* and 245*b* are biased against the side wall at the bottom of the channel, as best shown in FIG. 13. The end portion 232 of the carrier 220 also pivotally supports a detent 248 in the form of an L-shaped piece of wire 248 having one end pivotally received in a longitudinally extending opening in the end portion 232 and its other end biased by the leg 245*a* of the hair spring toward engagement with the blocking member 160, the leg 248*a* of the L-shaped detent 248 extending through the slot 156 in the side wall 155 of the side portion 152 of the housing 130**.

Figure 7:
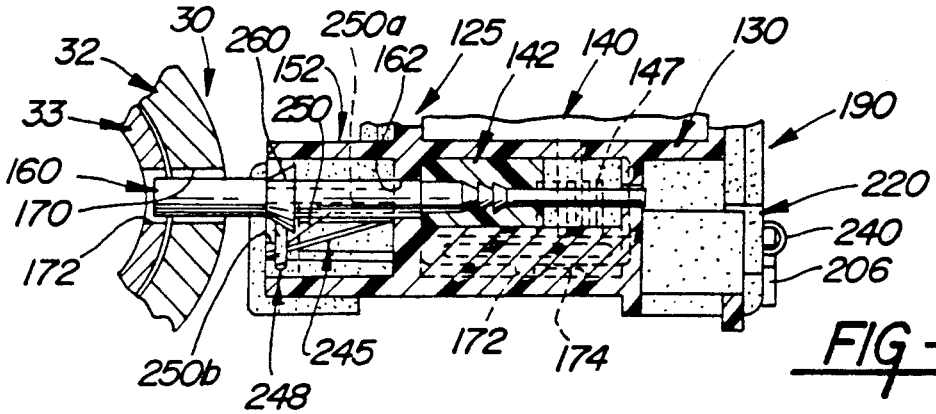
FIG. 7 is a fragmentary sectional view of part of the lock and control assembly shown in FIG. 6 and which is taken along the line 7—7 of FIG. 6.
Figure 11:
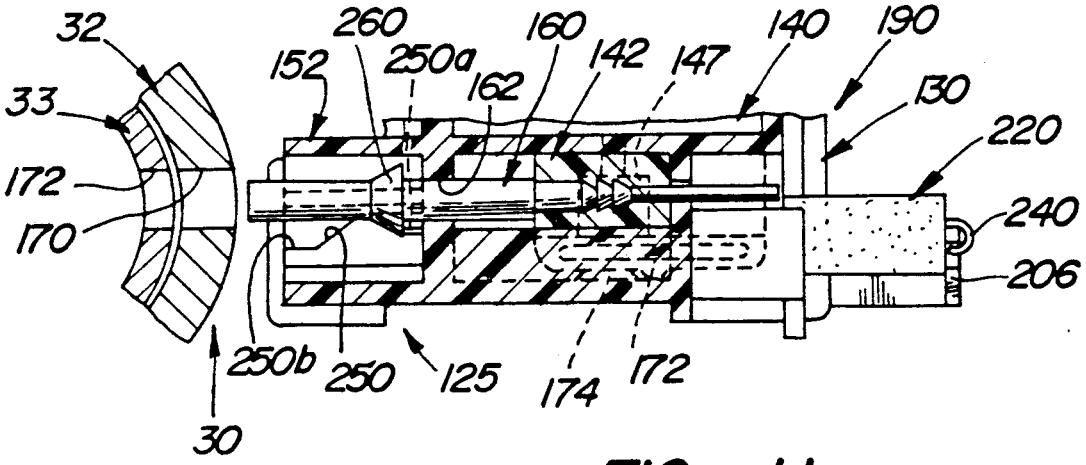
FIG. 11 is a fragmentary sectional view like that shown in FIG. 9 but showing different parts thereof in different positions.

As can be best seen in FIGS. 7 and 11, the slot 156 in the side wall 155 of the side portion 152 of the housing 130 is shaped so as to be wider at its left end then its right end and defines a tapered ramp surface 250 intermediate its ends. Thus, the surface defining one side of the slot 156 includes a longitudinally extending surface portion 250*a* adjacent the side wall 134 of the housing 130, a longitudinally extending portion 250*b* at its other end, the portions 250*a* and 250*b* being interconnected by the tapered ramp surface 250. The leg 245*a* of the hair spring 245 biases the leg 248*a* of the L-shaped detent 248 into engagement with this surface defining the slot 156.

The detent 248 is biased into engagement with the blocking member 160 by the hair spring 245 with the detent 248 extending through the slot 156 in the common wall 155 between the blocking member 160 and the carrier 220. The blocking member 160 intermediate its ends has an enlarged diameter shoulder portion 260. The shoulder portion 260 is defined by a tapered surface 260*a* which faces towards the lock cylinder casing 32 and a radially extending shoulder surface 260*b* which faces away from the casing 32 of the lock cylinder 34.

The operation of the mechanical override means 190 will now be described in detail. As noted before, when the operator decides to unlock the lock cylinder assembly by pushing the switch means 161 in the interior of the vehicle, the electric motor 140 will be rotated to move the rack 142 and the blocking member 160 from its locked position, as shown in FIG. 6, to its unlocked position, as shown in FIG. 8. When the blocking member 160 is in the FIG. 8 position, the winged finger engaging means 35 can be rotated to unlock and open the window and unlock the tailgate portion by manual manipulation because the lock cylinder and sleeve 33 will rotate in unison relative to the casing 32. However, should a power failure occur or the electrically energizable means 140 experiences a failure, there would normally be no way of moving the blocking member 160 from its unlocked position as shown in FIG. 8, to its locked position, as shown in FIG. 6. However, in such an event, the operator can use the mechanical override means 190 to effect movement of the blocking member 160 from the position shown in FIG. 8 to its locked position shown in FIG. 6 by merely, in the preferred embodiment, closing the window portion 20. The mechanical override means 190 can also be used as a matter of operator convenience even if there is no power failure.

In the lock and control assembly shown and thus far described, when the winged finger engaging means 35, which was previously rotated in a counterclockwise direction to cause the detent lever 72 to be rotated to release the striker 36 from the fork bolt 42 to enable the window to be opened, the movement of the lever 72 in a clockwise direction, as viewed in FIG. 5, caused the strap 84 to be moved downwardly. This downward movement of the strap 84 also caused the lever 200 to be rotated on its pivot means 207 in a clockwise direction, as viewed in FIG. 12 in opposition to the biasing force of the torsion spring 212. Movement of the lever 200 in this direction by the strap 84 also causes the end 205 of the leg 203 of the lever 200 to pull on the tension spring 240 to move the carrier 220 from its position shown in FIGS. 6–9 to its position as shown in FIG. 11. That is, the carrier 220 is caused to be moved to the right, as viewed in FIG. 11, or to the left, as viewed in FIG. 12. During this movement the spring biased detent 248 which is biased into engagement with the blocking member 160, slides along the side surface of the slot 156 first along the end portion 250*b* then the ramp portion 250 and then the remaining portion 250*a*. However, as the detent leg 248*a* of the detent 248 engages the tapered surface 260*a* of the shoulder 260 on the blocking member 160, it is caused to be cammed away from the blocking member 160 until it is moved sufficiently to the right, as viewed in FIG. 11, until it can snap behind the radially extending surface 260*b* of the shoulder 260. The detent leg 248*a* will be held behind the shoulder 260 by the force of the spring 245. The lever 200 and carrier 220 are at all times retained in the FIG. 11 position while the window 20 is open due to the fact that the strap 84 is held in its downward position by the detent lever 72.

Should there be a power failure or a failure in the electrically operable locking means 140, the operator need merely close the gate portion 22 of the tailgate and then move the window 20 towards its closed position. As the window moves towards its closed position, the striker bar 36 will engage the fork bolt 42 and rotate the same in a clockwise direction, as viewed in FIG. 10, until the detent portion 76 clears the pawl or detent 75 on the lever 72, which in turn causes the lever 72 to be pivoted in a counterclockwise direction by the torsion spring 78 and the strap 84 to be pulled upwardly to its FIG. 5 position. This upward movement of the strap 84 allows the torsion spring 212 to pivot the lever 200 in a clockwise direction causing the end portion 205 of the leg 203 of the lever 200 to move the carrier 220 via the spring 240 from its position shown in FIG. 11 toward its position shown in FIG. 9 or causes the carrier to be moved toward the right as viewed in FIG. 12. Since the detent 248 is engaged behind the shoulder 260 on the blocking member 160, the latter will be caused to be moved by the carrier 220 from the position shown in FIG. 11 towards its position shown in FIG. 6 in which the blocking member 160 will be received within the aligned openings 170, 172 in the casing 32 and the sleeves 33, respectively. However, when the blocking member 160 is received in the openings in the casing 32 and the sleeve 33, the detent 248 will engage the tapered ramp surface 250 of the slot 156 and be cammed outwardly and clear of the shoulder 260 on the blocking member 260 and be retained out of engagement therewith by the surface 250*b*, as clearly shown in FIG. 9. Once in this position and with the blocking member 160 in its locked position, as shown in FIG. 6, even if the carrier 220 were thereafter moved back and forth, it would merely ride on the surface of the blocking member 160 behind the tapered shoulder 260 or the side ramp surface 250 of the slot and not affect movement of the blocking member 160. This ensures that the mechanical override means 190, although operable to effect movement of the blocking member 160 from its unlocked position to its locked position cannot thereafter be used to ever affect movement of the blocking member 160 from its locked position to its unlocked position.

It should also be noted that the lock and control assembly thus far described can also be used with a tailgate which is hinged at its top rather than at its sides and in which the window 20 is stationary in the tailgate, as shown in FIG. 2. In such an application, the fork bolt 42 would be held stationary, such as by bending the upper end 162 of the frame so it is disposed within the throat 42*c* of the fork bolt 42 so that it cannot be moved. In this application, the rotation of the winged finger engaging means 35 in a counterclockwise direction, as viewed in FIG. 1, to effect opening of the window 20 would be ineffective and would merely cause the lever 86 to rotate without effecting any movement of the fork bolt 42. It would, however, rotate the detent lever 72 and move strap 84 downwardly, which in turn would rotate actuating lever 200, whose end portion 205 is in engagement with flange 84*b* of the strap 84. The tailgate, however, could be unlatched in the same manner by rotating the winged finger engaging means 35 in a clockwise direction, as viewed in FIG. 1, to effect the same movement as heretofore described for opening the locking and unlocking the tailgate.

It should be noted that in this latter application, should there be a power failure in the electrically operated means, the mechanical override means 190 can also function in much the same manner as previously described. In this application, since the window was never opened, the actuating lever 200 would have at all times remained in its normal position in which the end 205 thereof would be in engagement with the side 133 of the housing 130 and the detent carried by the carrier would be in the position shown in FIG. 9. To effect operation of the override means 190 in this mode, should there be a failure, the operator need merely to rotate the winged finger engaging portion 35 in a counterclockwise direction, as viewed in FIG. 1, to cause the detent lever 72 to rotate, which in turn causes the strap 84 to be moved downwardly and the actuating lever 200 to be pivoted in a clockwise direction, as viewed in FIG. 12, to pull the carrier 220 outwardly of the housing 130 from its position shown in FIG. 9 towards its position shown in FIG. 11. During this movement, the detent 248, which is biased toward engagement with the blocking member 160 by the spring 245, would ride on the blocking member 160, engage the ramp 260*a* of the shoulder 260 and then be snapped behind the shoulder 260. Then upon release of the finger engaging means 35, the coil spring 120 returning the same towards its center or neutral position, the torsion spring 212 would rotate the lever 200 in a counterclockwise direction, as viewed in FIG. 12, to effect movement of the carrier 220 from its FIG. 11 position towards is FIG. 9 position in which the detent 248 would move the blocking member 160 into the openings 170, 172 in the casing 32 and the sleeve 33 to affect locking therebetween and prevent the lock cylinder 34 and sleeve from being rotated in unison. Thereafter any turning movement of the finger engaging portion 35 would be prevented without the insertion of the key in the lock cylinder 34.

Further, it should be noted that instead of having the lever 200 operatively associated with the flange 84*b* of the strap 84 the leg 202 thereof could be directly connected to a manually manipulatable rod regardless of whether the tailgate had a movable window or not. The rod would be carried by the gate portion and, preferably, be accessible from the exterior of the gate. Thus, the lever 200 would be movable independently of any movement the strap 84. As shown in FIG. 14, in this application, should there be a power failure after operation of the electrical operable means 140, the operator need merely depress a button 280 connecting a rod 282 to the leg 202 of the lever 200 to cause the same to be rotated in a counterclockwise direction to effect movement of the carrier 220 from its position shown in FIG. 9 to its position shown in FIG. 11 or to effect movement of the carrier 220 toward the left, as viewed in FIG. 12. As previously described, during this movement, the detent 248 which is biased toward engagement with the blocking member 160 by the spring 245 will ride on the blocking member 160 and be cammed outwardly over the ramp surface 260*a* of the shoulder 260 of the blocking member 160 and then snap behind the radially extending shoulder surface 260*b*. Upon release of the button 280, the torsion spring 212 would pivot the lever in a counterclockwise direction, as viewed in FIG. 12, and cause the carrier 220 to be moved from its FIG. 11 position towards its FIG. 9 position or cause the carrier 220 to be moved toward the left, as viewed in FIG. 12. During this movement, the detent 248 would move the blocking member 160 from the position shown in FIG. 11 towards its position shown in FIG. 6 in which it is disposed within the openings 170, 172 in the casing 32 and sleeve 33 and with the detent 248 being cammed outwardly away after such movement by the ramp surface 250 of the surface defining the slot 156. Thereafter, any further manipulation of the button 280 and rod 282 would not affect any movement of the blocking member 160, since the detent would merely ride on the shank portion of the blocking member 160 behind the shoulder 260. Alternately, instead of the button 280 and rod 282, the lever 200 could be shaped so that its leg 202 would extend upwardly so that the lever could be manually pushed via the operator's finger to cause the lever 200 to be pivoted.

From the foregoing, it should be apparent that a novel lock and control assembly for a tailgate of an automotive vehicle has been provided. The lock and control assembly can either be actuated to its locked and unlocked positions via the operation of a key in the usual cylinder lock or can be remotely actuated between its locked and unlocked positions by depressing a switch in the interior of the passenger compartment of the vehicle. In addition it is fail-safe in that in the event that a power failure or a failure in the reversible electric motor occurs, the tailgate can be relocked to its locked position by a mechanical override means which is of a relatively simple and economical construction and which is effective only to move a blocking member for locking a rotatable sleeve to a casing of the lock cylinder mechanism, but is ineffective to move the same from its locked position towards its unlocked position. To effectuate the latter, the operator would have to use a key to rotate the lock cylinder.

Although the illustrated embodiments hereof have been described in great detail, it should be apparent that certain modifications, changes and adaptations may be made in the illustrated embodiments, and that it is intended to cover all such modifications, changes and adaptations which come within the spirit of the present invention.

The embodiments of the invention in which an exclusive property of privilege is claimed are defined as follows:

1. A lock and control assembly for use with a vehicle having a tailgate which is pivotally movable between open and closed positions, said control assembly comprising:

a support frame carried by said tailgate;

latch means for latching and unlatching said tailgate to and from associated body structure of the vehicle when in its closed position;

said latch means including a first level pivotally supported by said support frame for movement between first and second positions;

a cylinder lock actuating mechanism carried by said tailgate and operatively associated with said first level for pivotally moving the same from its first position toward its second position to effect unlatching of said tailgate from said vehicle when rotated in a first direction from its normal position, said lock actuating mechanism comprising a stationary casing, a cylindrical sleeve rotatably supported by said casing, a key operated lock cylinder supported by said sleeve and an actuator member rotatable with said lock cylinder and operatively associated with said first lever, said lock cylinder being rotatable relative to said sleeve upon insertion of a key to cause said actuator member to move said first pivotal lever to effect unlatching of said tailgate when rotated in said first direction and being locked against rotation relative to said sleeve when the key is removed, manually manipulatable means located exteriorly of said tailgate to enable said lock cylinder to be rotated relative to said sleeve when said key is inserted therein, and a selectively operable, power operated locking means including a reciprocable blocking member for locking and unlocking said sleeve to and from said stationary casing, said reciprocable blocking member being movable between a locked position in which it extends through aligned openings in said casing and said sleeve to lock the sleeve and lock cylinder against rotation in unison relative to the casing by said manually manipulatable means and an unlocked position in which the blocking member is retracted from said opening in said sleeve to permit rotation of said sleeve and lock cylinder in unison relative to said casing by said manually manipulatable means, the improvement comprising a manually operated mechanical override means including a reciprocable member operatively associated with said reciprocable blocking member for effecting movement of said blocking member, when manually operated, from its unlocked position to its locked position to lock said sleeve and locking cylinder against rotation in unison relative to said stationary casing in the event there is a power failure or a malfunction of the power operated means so that said tailgate can be locked in its closed position, said mechanical override means at all times being ineffective to move said blocking member from its locked position to its unlocked position even if said reciprocable member is reciprocated.

2. A lock and control assembly, as defined in claim 1, and wherein said reciprocable blocking member comprises a pin having a radially extending shoulder intermediate its ends, and wherein said mechanical override means comprises a carrier reciprocably supported by said power operated means adjacent to said blocking member for movement between first and second positions, a spring biased detent carried by said carrier for movement therewith and engageable with said blocking member, said spring biased detent being detentable behind said shoulder on said blocking member when the blocking member is in its unlocked position in response to the carrier being moved from its second position toward its first position, said detent causing said blocking member to be moved from its unlocked position toward its locked position when the carrier is moved from its first position toward its second position, said detent thereafter riding on said blocking member without engaging said shoulder thereon should said carrier be reciprocated whereby said detent is only effective to move said blocking member from its unlocked position to its locked position and not from its locked position to its unlocked position.

3. A lock and control assembly, as defined in claim 1, and wherein said reciprocable blocking member comprises a pin having a radially extending shoulder intermediate its ends and wherein said override means includes a carrier reciprocably supported by said power operated locking means adjacent to said blocking member for movement between first and second positions, a spring biased detent carried by said carrier for movement therewith and which is biased toward engagement with said blocking member, and an actuating means supported for movement in opposite directions and operatively connected with said carrier for moving the latter between its positions, said actuating means including a spring means for biasing said carrier toward its second position, said spring biased detent being cammed over and then snapping behind said shoulder on said blocking member when the latter is in its unlocked position and when said carrier is moved from its second position toward its first position in response to moving said actuating means in opposition to its spring means in a first direction, said detent engaging said shoulder on said blocking member and moving the latter toward its locked position when the spring means causes the actuating means to move in the opposite direction to move from the carrier its first position toward its second position.

4. A lock and control assembly, as defined in claim 1, and wherein said power operated means comprises a housing means, a rack connected with said blocking member and which is slidably supported by said housing means for reciprocable movement to move said blocking member between its locking and unlocking positions, a reversible electric motor carried by said housing means for rotating a pinion gear in meshed engagement with the rack in opposite directions, a control means including a selectively operable switch for energizing and controlling the direction of rotation of said motor to reciprocably move said rack and blocking member between their positions.

5. A lock and control assembly, as defined in claim 4, and wherein said rack includes an integral deflectable bowed spring having a detent which rides against a wall surface in said housing means and said wall surface of said housing means having a nib extending toward said bowed spring and in the path of movement of said detent, said bowed spring being deflectable upon said detent engaging said nib as the rack approaches the end of its travel in either direction until it clears said nib adjacent the end point of the travel of the rack whereby the rack is detented in the position to which it is moved so that it will remain thereat until the motor is reenergized to move the rack in the opposite direction.

6. A lock and control assembly, as defined in claim 1, and wherein said blocking member has an enlarged diameter portion defining a shoulder, and wherein said mechanical override means comprises a carrier slidably supported by said housing means for reciprocable movement relative thereto between first and second positions toward and from said cylinder lock actuating mechanism, a return element pivotally supported by said carrier for movement about an axis parallel to the longitudinal axis of the reciprocable blocking member and having an end which projects through a slot in a common wall of said housing means separating said carrier from said blocking member, first spring means carried by said carrier for biasing said end of said return element toward said blocking member, an actuating lever pivotally supported for movement in opposite directions and being operatively connected with said carrier, second spring means for biasing said lever for movement in one direction in which it effects movement of the carrier toward its first position, means operatively associated with said actuating lever for effecting movement of said lever in its opposite direction in opposition to the biasing force of said second spring means to move said carrier from its first position toward its second position, said end of said return element being cammed away from the axis of said blocking member by said enlarged diameter portion of said blocking member until said end clears said shoulder on said enlarged diameter portion whereupon said first spring means snaps said return element behind said shoulder when said carrier is moved toward its second position and when said blocking member is in its unlocked position, said second spring means being operable to move said lever in said one direction and said carrier from its second position toward its first position and with the end of said return element effecting movement of said blocking member from its unlocked position to its locked position when said lever is released, said common wall including a ramp for guiding and pivoting said end of said return element in opposition to the biasing force of said first spring away from the axis of said blocking member when the carrier member approaches its first position whereby said end of said return element merely rides on said blocking member or ramp should the carrier be subsequently reciprocably moved when the blocking member is in its locked position.

7. A lock and control assembly for use with a vehicle tailgate having a window hinged adjacent its top for movement between open and closed positions and a gate which is pivotally movable between open and closed positions, said gate and window meeting one another at opposite adjacent edges when the window is closed, said control assembly comprising:

a support frame carried by said gate of said tailgate;

releasable means including a pivotal blot and striker on the frame and window, respectively, for holding the window in its closed position, a first actuating lever pivotally mounted on said frame, first connector means attaching said first lever to said releasable window means so that pivotal movement of said first lever in one direction releases the window for movement from its closed position toward an open position, a second actuating lever pivotally supported by said frame adjacent said first actuating lever, gate latch means for latching and unlatching said tailgate to and from associated body structure of the vehicle when in its closed position;

second connector means between said second lever and said gate latch means so that pivotal movement of the second lever in the other rotational direction opposite to said one direction actuates said gate latching means, a cylinder lock actuating mechanism carried by said tailgate and operatively associated with said first lever and second levers for respectively pivotally moving the same when rotated in opposite directions to effect release of said window and said gate, said cylinder lock actuating mechanism comprising a stationary casing, a cylindrical sleeve rotatably supported by said casing, a key operated lock cylinder supported by said sleeve and an actuator member rotatable with said lock cylinder and operatively associated with said first and second levers, said lock cylinder and actuator member being rotatable in opposite directions relative to said sleeve upon insertion of a key to cause said first and second pivotal levers to be rotated to effect release of said window and unlatching of said tailgate, respectively, said lock cylinder and actuator member being locked against rotation relative to said sleeve when the key is removed, said lock cylinder having manually manipulatable means located exteriorly of said tailgate to enable said lock cylinder to be rotated relative to the sleeve when the key is inserted therein, and a selectively operable, power operated locking means including a reversible electric motor and reciprocable blocking member for locking and unlocking said sleeve to and from said stationary casing;

said reciprocable blocking member being movable between a locked position in which its extends through aligned openings in said casing and said sleeve to lock the sleeve and lock cylinder against rotation in unison relative to the casing by said manually manipulatable means and an unlocked position in which the blocking member is retracted from said opening in said sleeve to permit rotation of said sleeve and lock cylinder in unison relative to said casing by said manually manipulatable means, the improvement comprising a manually operated mechanical override means including a reciprocable member operatively associated with said reciprocable blocking member for effecting movement of said blocking member, when manually operated, from its unlocked position to its locked position to lock said sleeve and locking cylinder against rotation in unison relative to said stationary casing in the event there is a power failure or a malfunction of the power operated means so that said tailgate can be locked in its closed position, said mechanical override means at all times being ineffective to move said blocking member from its locked position to its unlocked position even if said reciprocable member is reciprocated.

8. A lock and cylinder assembly, as defined in claim 7, and wherein said reciprocable blocking member comprises a pin having a radially extending shoulder intermediate its ends, and wherein said mechanical override means comprises a carrier reciprocably supported by said power operated means adjacent to said blocking member for movement between first and second positions, a spring biased detent carried by said carrier for movement therewith and engageable with said blocking member, said spring biased detent being detentable behind said shoulder on said blocking member when the blocking member is in its unlocked position in response to the carrier being moved from its second position toward its first position, said detent causing said blocking member to be moved from its unlocked position toward its locked position when the carrier is moved from its first position toward its second position, said detent thereafter riding on said blocking member without engaging said shoulder thereon should said carrier be reciprocated whereby said detent is only effective to move said blocking member from its unlocked position to its locked position and not from its locked position to its unlocked position.

9. A lock and cylinder assembly, as defined in claim 7, and wherein said reciprocable blocking member comprises a pin having a radially extending shoulder intermediate its ends and wherein said override means includes a carrier reciprocably supported by said power operated locking means adjacent to said blocking member for movement between first and second positions, a spring biased detent carried by said carrier for movement therewith and which is biased toward engagement with said blocking member, and an actuating means supported for movement in opposite directions and operatively connected with said carrier for moving the latter between its positions, said actuating means including a spring means for biasing said carrier toward its second position, said spring biased detent being cammed over and then snapping behind said shoulder on said blocking member when the latter is in its unlocked position and when said carrier being moved from its second position toward its first position in response to moving said actuating means in opposition to its spring means in a first direction, said detent engaging said shoulder on said blocking member and moving the latter toward its locked position when the spring means causes the actuating means to move in the opposite direction to move the carrier from its first position toward its second position.

10. A lock and cylinder assembly, as defined in claim 7, and wherein said blocking member has an enlarged diameter portion defining a shoulder, and wherein said mechanical override means comprises a carrier slidably supported by said housing means for reciprocable movement relative thereto between first and second positions toward and from said cylinder lock actuating mechanism, a return element pivotally supported by said carrier for movement about an axis parallel to the longitudinal axis of the reciprocable blocking member and having an end which projects through a slot in a common wall of said housing means separating said carrier from said blocking member, first spring means carried by said carrier for biasing said end of said return element toward said blocking member, an actuating lever pivotally supported for movement in opposite directions and being operatively connected with said carrier, second spring means for biasing said actuating lever for movement in one direction in which it effects movement of the carrier toward its first position, means operatively associated with said actuating lever for effecting movement of said actuating lever in its opposite direction in opposition to the biasing force of said second spring means to move said carrier from its first position toward its second position, said end of said return element being cammed away from the axis of said blocking member by said enlarged diameter portion of said blocking member until said end clears said shoulder on said enlarged diameter portion whereupon said first spring means snaps said return element behind said shoulder when said carrier is moved toward its second position and when said blocking member is in its unlocked position, said second spring means being operable to move said lever in said one direction and said carrier from its second position toward its first position and with the end of said return element effecting movement of said blocking member from its unlocked position to its locked position when said lever is released, said common wall including a ramp for guiding and pivoting said end of said return element in opposition to the biasing force of said first spring means away from the axis of said blocking member when the carrier member approaches its first position whereby said end of said return element merely rides on said blocking member or ramp should the carrier be subsequently reciprocably moved when the blocking member is in its locked position.

11. A lock and cylinder assembly, as defined in claim 1, and wherein said mechanical override means is operatively associated with said actuating member on said lock cylinder and is actuated in response to movement of said lock cylinder in a second direction from its normal position which is opposite to said first direction and return movement back to its normal position.

12. A lock and cylinder assembly, as defined in claim 1, and wherein said mechanical override means is actuated by a manually movable member.

13. A lock and control assembly, as defined in claim 3, and wherein said mechanical override means includes a manually manipulatable member operatively connected with said actuating means operatively connected with said carrier for effecting movement of said actuating means.

14. A lock and control assembly, as defined in claim 6, and wherein said means for effecting movement of said actuating lever of said override means in said opposite direction comprises a manually manipulatable reciprocable rod connected with said actuating lever.

15. A lock and control assembly, as defined in claim 7, and wherein said mechanical override means is actuated in response to movement of the window portion to its closed position.

* * * * *